United States Patent [19]

Nakamura et al.

[11] 4,404,892

[45] Sep. 20, 1983

[54] HYDRAULIC OPERATING APPARATUS

[75] Inventors: Ichiro Nakamura; Mitsuaki Takenoshita, both of Katsuta; Ken Ichiryu, Mito; Yoshimichi Akasaka; Haruo Watanabe, both of Hitachi, all of Japan

[73] Assignee: Hitachi, Ltd., Tokyo, Japan

[21] Appl. No.: 217,844

[22] Filed: Dec. 18, 1980

[30] Foreign Application Priority Data

Dec. 27, 1979 [JP] Japan ..... 54-169253

[51] Int. Cl.[3] ..... F15B 15/22

[52] U.S. Cl. ..... 91/396; 91/404; 91/417 R; 91/448; 91/461; 91/519

[58] Field of Search ..... 91/417 R, 396, 404, 91/448, 165, 394, 395, 25, 26, 519

[56] References Cited

U.S. PATENT DOCUMENTS

| | | | |
|---|---|---|---|
| 3,363,512 | 1/1968 | Ottestod | 91/417 R |
| 3,363,513 | 1/1968 | Ottestod | 91/417 R |
| 3,418,887 | 12/1968 | Matteson | 91/417 R |
| 3,817,152 | 6/1974 | Viron | 91/519 |
| 3,969,985 | 7/1976 | Grieger et al. | 91/417 R |

*Primary Examiner*—Paul E. Maslousky
*Attorney, Agent, or Firm*—Antonelli, Terry & Wands

[57] ABSTRACT

A hydraulic operating apparatus including an actuating cylinder having a piston arranged therein and moved by a fluid under high pressure further includes a control valve having only one metallic seal whether the piston is at its upper or lower positions. The control valve is operative to apply the fluid under high pressure to a pressure receiving surface of the piston on the opposite side of a piston rod to move the piston in a direction in which the piston rod extends from the piston and to discharge the fluid existent on the opposite side of the piston rod from the actuating cylinder to move the piston in a direction opposite the direction in which the piston rod extends from the piston. The hydraulic operating apparatus further includes a seal for dividing the pressure receiving surface of the piston on the opposite side of the piston rod into first and second pressure receiving surface sections, the first pressure receiving surface section having an effective pressure receiving area smaller than that of a pressure receiving surface of the piston on the side of the piston rod.

9 Claims, 3 Drawing Figures

HYDRAULIC OPERATING APPARATUS

BACKGROUND OF THE INVENTION

This invention relates to a hydraulic operating apparatus wherein a piston in a cylinder is actuated by a fluid under high pressure and, more particularly, to a hydraulic operating apparatus wherein the action of the fluid under high pressure exerted on a pressure receiving surface of the piston on the opposite side of a piston rod is improved.

In hydraulic operating apparatus known in the art, a fluid under high pressure is applied at all times to a pressure receiving surface of the piston of an actuating cylinder on the side of the piston rod, and a control valve associated with the actuating cylinder is actuated to apply the fluid under high pressure to the pressure receiving surface of the piston on the opposite side of the piston rod to thereby produce a pressure differential commensurate with the difference in area between the two pressure receiving surfaces, so as to move the piston by the pressure differential in a direction in which the piston rod extends from the piston. Also, the piston is moved at high speed in a direction opposite the direction in which the piston rod extends from the piston by discharging the fluid existent on the opposite side of the piston rod.

This type of hydraulic operating apparatus is used as a driving unit such as used with an emergency circuit breaker for an electric power system which unit is required to have high speed operation.

Some disadvantages are associated with prior hydraulic operating apparatus. Conventional hydraulic operating apparatus have to fulfill several requirements. One of such requirements is that sealing must be maintained over a prolonged period of time to the control valve for admitting a fluid under high pressure to the portion of the actuating cylinder on the side of the piston opposite the piston rod and discharging same therefrom, to avoid leakage of the fluid under high pressure to a low pressure tank which should act on the side of the piston opposite the piston rod. Another requirement is that a seal must be provided over a prolonged period of time to the control valve to prevent the fluid under high pressure from acting on the pressure receiving surface of the piston on the side thereof opposite the piston rod, so as to maintain the piston in a position in which it is located at the end of the actuating cylinder on the side of the piston opposite the piston rod. The need to meet all of these requirements renders the construction of the control valve complex, thereby raising the problem that difficulties are experienced in providing a satisfactory seal to the control valve. As a result, the provision of a satisfactory seal to the control valve to keep its performance at a high level in actual use entails a very high degree of precision finishes and hence an increase in production cost.

SUMMARY OF THE INVENTION

This invention has been developed for the purpose of obviating the aforesaid disadvantages of the prior art. Accordingly, it is an object of the invention to provide a hydraulic operating apparatus of simple construction which enables a satisfactory sealing to be provided in the control valve without requiring a high degree of precision finishes being given to its component parts.

The characterizing feature of the present invention which enables the aforesaid object to be accomplished comprises sealing means provided in a fluid pressure actuating system of the type described, such sealing means being operative to divide the pressure receiving surface of the piston on the opposite side of the piston rod into a first pressure receiving surface section smaller in area than the pressure receiving surface of the piston on the side of the piston rod, and a second pressure receiving surface section, when the piston of the actuating cylinder is located at its terminal position on the opposite side of the piston rod. By this feature, the fluid under high pressure only acts on the first pressure receiving surface section when the piston is located at its terminal position on the opposite side of the piston rod, and acts on both the first pressure receiving surface section and the second pressure receiving surface section when the piston has moved from the position at its terminal position on the opposite side of the piston rod. By virtue of the sealing means of simple construction provided to the actuating cylinder itself, simplification of the control valve function can be achieved.

DESCRIPTION OF THE PREFERRED EMBODIMENTS

Figure 1:
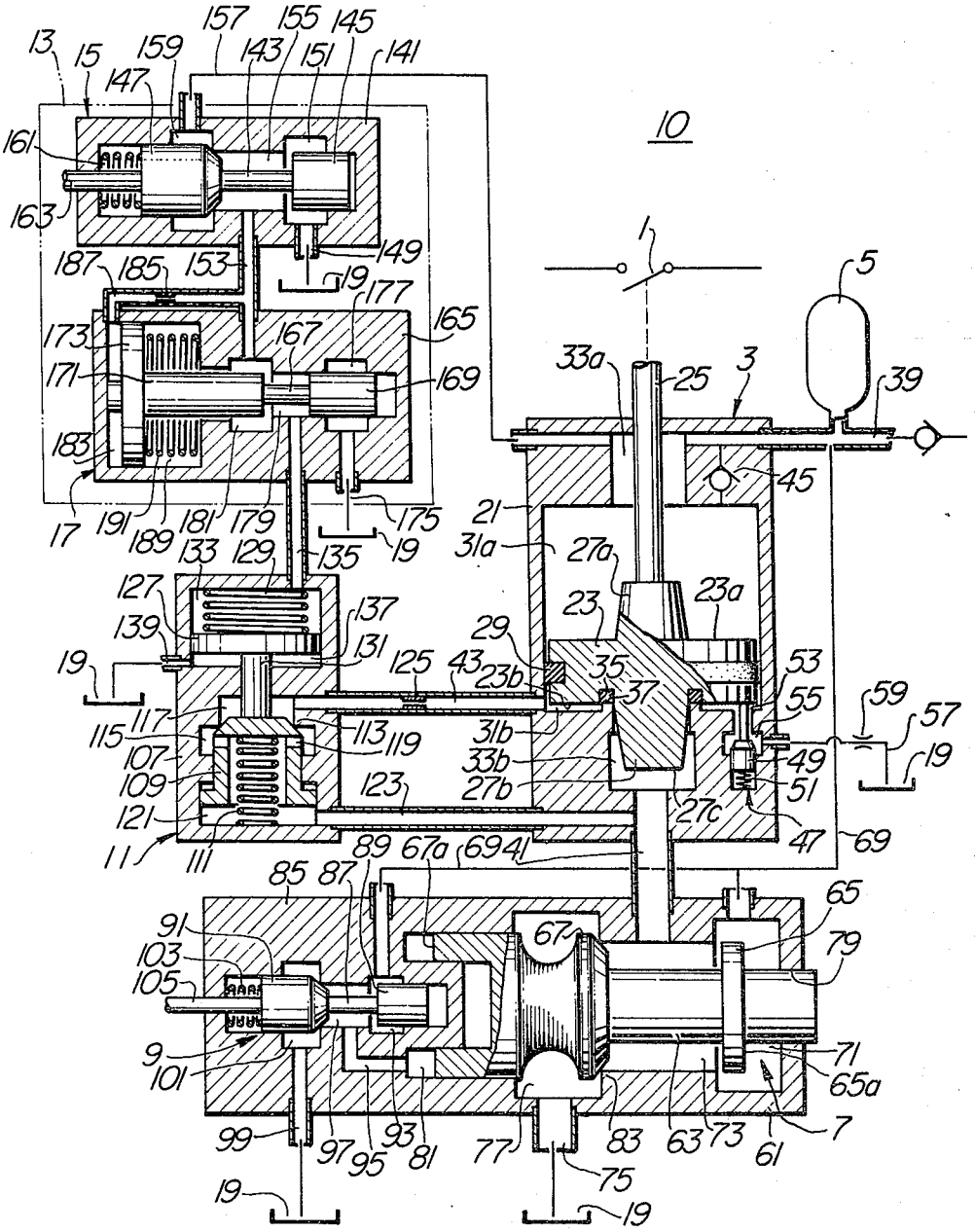
FIG. 1 is a sectional view of a hydraulic driving apparatus according to a first embodiment of the invention.

FIG. 1 shows a hydraulic operating apparatus 10 according to a first embodiment of the invention which apparatus is adapted for use as an emergency circuit breaker for an electric power system. As shown, the hydraulic operating apparatus according to the invention comprises an actuating cylinder 3 for opening and closing a contact 1 of an emergency circuit breaker, an accumulator 5 for storing therein a fluid under pressure which is supplied from a high pressure fluid supply source (not shown) and serves to drive the actuating cylinder 3, a control valve 7 for actuating the actuating cylinder 3, a circuit breaking pilot valve 9 for actuating the control valve 7 upon receipt of a command to break the circuit, a pilot-operated check valve 11 for starting the operation of the actuating cylinder 3 for closing of the contact 1, and a circuit-closing pilot section 13 for actuating the pilot-operated check valve 11 upon receipt of a command to close the circuit. The circuit-closing pilot section 13 comprises a circuit-closing pilot valve 15 and an antipumping valve 17. The reference numeral 19 designates a low pressure (normally atmospheric pressure) tank for collecting the fluid after having performed its function.

The actuating cylinder 3 comprises a cylinder body 21 and a piston 23 for sliding movement therein. The piston 23 comprises a piston rod 25 for transmitting a force generated in the piston 23 to the outside, and tapered cushion projections **27*a* and 27*b* formed integrally with the piston 23 for smoothly stopping the piston 23 near the terminal ends of its strokes. Mounted on the outer circumferential surface of the piston 23 is a packing 29 which is contacted with the inner circumferential surface of the cylinder body 21 and divides the interior of the cylinder body 21 into an upper fluid chamber 31***a* disposed on the side of the piston rod 25, and a lower fluid chamber 31*b* disposed on the opposite side of the piston rod 25. Shock-absorbing fluid chambers 33*a* and 33*b* are defined at the opposite ends of the cylinder body 21 for receiving therein the cushion projections 27*a* and 27*b*, respectively, of the piston 23. The piston 23 includes a pressure receiving surface on the opposite side of the piston rod 25 which surface mounts thereon an annular packing 35 serving as seal means and is divided into a central or first pressure receiving surface 27*c*, that is, the surface of the cushion projection 27*b*, and a second pressure receiving surface 23*b* surrounding the first pressure receiving surface 27*c*. The cylinder body 21 is formed with a projection 37 adapted to abut against the packing 35. Thus when the piston 23 is located at the terminal end of its stroke on the opposite side of the piston rod 25, the packing 35 sealingly separates the two fluid chambers 33*b* and 31*b* from each other.

The fluid chamber 33*a* at the top of the cylinder body 21 communicates with the accumulator 5 through a flow passage 39 and thus the pressure receiving surface 23*a* of the piston 23 on the side of the piston rod 25 is always exposed to the fluid under high pressure. The fluid chamber 33*b* at the bottom of the cylinder body 21 communicates with the control valve 7 through a flow passage 41, and the fluid chamber 31*b* communicates with the pilot-operated check valve 11 through a flow passage 43.

A first check valve 45 is provided in the cylinder body 21 on the side of the piston rod 25 to supply a fluid under high pressure to the fluid chamber 31*a* when the piston 23 starts to move from the terminal position on the side of the piston rod 25. A second check valve 47 is provided in the cylinder body 21 on the opposite side of the piston rod 25 and includes a poppet 49 having a rod portion and movable in a fluid chamber 55, and a spring 51 for urging the poppet 49 in the closing direction. The check valve 47 is closed by the action of the spring 51 when the piston 23 is away from its terminal position on the opposite side of the piston rod 25. However, as the piston 23 reaches its lower terminal position of the stroke, the rod portion of the poppet 49 is pushed by the piston 23 to open the second check valve 47, so that the fluid in the fluid chamber 31*b* is discharged to the low pressure tank 19 through a port 53 in the cylinder body 21, fluid chamber 55, flow passage 57 and restriction 59 in the flow passage 57. Thus the pressure of the fluid chamber 31*b* could be prevented from being increased even if the fluid under high pressure leaked from the fluid chambers 31*a* and 33*b* due to any accidental failure of the packings 29 and 35.

As the surface 27*c* of the cushion projection 27*b* has an effective pressure receiving area smaller than that of the pressure receiving surface 23*a* on the side of the piston rod 25, it follows that when the piston 23 is in its lower terminal position as shown in FIG. 1 the fluid under high pressure acts only on the cushion projection 27*b* and the piston 23 remains stationary.

The control valve 7 comprises a valve body 61 and a spool 63 having a land 65 and a poppet 67. A fluid chamber 71 communicated with the accumulator 5 through a flow passage 69 is brought in and out of communication by the land with a fluid chamber 73 communicated with the fluid chamber 33*b* of the actuating cylinder 3 through a flow passage 41. The poppet 67 brings the fluid chamber 73 into and out of communication with a fluid chamber 77 communicated with the tank 19 through a flow passage 75. An end face 65*a* of the spool 63 on the opposite side of the poppet 67 has an area $A_1$ corresponding to the difference in diameter between the land 65 and a bore 79 and is always exposed to the fluid under high pressure. Another end face 67*a* of the spool 63 on the side of the poppet 67 is located in a fluid chamber 81 communicated with the circuit-breaking pilot valve 9 and is exposed to the fluid under high pressure regulated by the circuit-breaking pilot valve 9. Denoting the area of the end face 67*a* of the spool 63 on the side of the poppet 67 by $A_2$, the relation $A_2 > A_1$ holds. Thus when the fluid under high pressure is introduced into the fluid chamber 81 from the accumulator 5, the spool 63 is urged to the right in FIG. 1 to seat the poppet 67 on a valve seat 83, and to communicate the fluid chambers 71 and 73 to each other, thereby introducing the fluid under high pressure to the fluid chamber 33*b* of the actuating cylinder 3. As the fluid under high pressure is discharged from the fluid chamber 81, the spool 63 is urged to the left in the figure to permit the land 65 to bring the fluid chambers 71 and 73 out of communication with each other, and the poppet 67 is moved out of engagement with the valve seat 83 to communicate the fluid chambers 73 and 77 with each other, thereby discharging the fluid under high pressure in the fluid chamber 33*b* of the actuating cylinder 3 to the tank 19.

The circuit-breaking pilot valve 9 in the form of a three-way valve comprises a valve body 85 and a spool 87. Preferably the circuit-breaking pilot valve 9 is arranged coaxial with the control valve 7 and close to the fluid chamber 81, and its valve body 85 is preferably formed integral with the valve body 61 of the control valve 7. The spool 87 has a land 89, a poppet 91 and a rod 105. Depending on the position of the land 89, a fluid chamber 93 communicated with the accumulator 5 through a flow passage 69 is brought into and out of communication with a fluid chamber 97 communicated with the fluid chamber 81 of the control valve 7 through a flow passage 95. Depending on the position of the poppet 91, the fluid chamber 97 is brought into and out of communication with a fluid chamber 101 communicated with the low pressure tank 19 through a flow passage 99. The spool 87 is normally urged to the right by the biasing force of a spring 103 to communicate the fluid chamber 93 with the fluid chamber 97 and to bring the fluid chamber 97 out of communication with the fluid chamber 101, thereby supplying the fluid under high pressure to the fluid chamber 81 of the control valve 7. As the spool 87 is pulled to the left through a rod 105 as by a force motor upon receipt of command to break the circuit, the fluid chambers 97 and 101 are brought into communication with each other and the fluid chambers 93 and 97 are brought out of communication with each other, so that the fluid in the fluid chamber 81 of the control valve 7 is discharged via the flow passage 95, fluid chambers 91 and 101 and flow passage 99 to the tank 19.

The pilot-operated check valve 11 comprises a valve body 107 and a poppet 109. The poppet 109 is normally urged by a spring 111 to be seated on a valve seat 113, thereby bringing fluid chambers 115 and 117 out of communication with each other. The fluid chamber 115 communicates with a fluid chamber 121 through a port 119 in the poppet 109, and then with the fluid chamber 33*b* of the actuating cylinder 3 through a flow passage 123. The fluid chamber 117 communicates with the fluid chamber 31*b* of the actuating cylinder 3 through the flow passage 43 mounting a restriction 125 therein. In the check valve 11, the poppet 109 is normally seated on a valve seat 113, so that the fluid under high pressure is prevented from flowing from the fluid chamber 121 toward the fluid chamber 117 or in the so-called reverse direction. The pilot-operated check valve 11 further comprises a piston 127 for pilot operation which piston is urged by a spring 129 to cause its piston rod 131 to abut against the poppet 109. As the spring 129 is weaker in biasing force than the spring 111, the poppet 109 is seated on the valve seat 113 in the normal condition. A fluid chamber 133 disposed on the opposite side of a piston rod 131 communicates with the circuit-closing pilot section 13 through a flow passage 135 while a fluid chamber 137 disposed on the side of the piston rod 131 communicates with the low pressure tank 19 through a flow passage 139. The piston 127 forces the poppet 109 downward away from the valve seat 113 to communicate the fluid chambers 117 and 121 with each other (to enable flow of the fluid under pressure in the reverse direction) when a pilot fluid pressure from the circuit-closing pilot section 13 is applied to the fluid chamber 133 in response to a circuit-closing command.

The circuit-closing pilot section 13 is responsive to a circuit-closing command to supply the fluid under high pressure to the fluid chamber 133 of the pilot-operated check valve 11. In this embodiment, in order that the circuit breaker may perform an 'anti-pumping' action, the circuit-closing pilot section 13 comprises the circuit-closing valve 15 and the anti-pumping valve 17 as aforesaid. In case where the command for closing the circuit is given in the course of the operation responsive to the command for opening the circuit and where the command for closing the circuit is kept given even after the release of the command for opening the circuit, it is necessary to neglect the particular command for closing the circuit and to hold the circuit in the open state until the next command for closing the circuit is given. This function is termed 'anti-pumping'.

The circuit-closing pilot valve 15 comprises a valve body 141 and a spool 143 including a land 145, a poppet 147 and a rod 163. Depending on the position of the land 145, a fluid chamber 151 communicated with the low pressure tank 19 through a flow passage 149 is brought into and out of communication with a fluid chamber 155 communicated with the antipumping valve 17 through a flow passage 153. Depending on the position of the poppet 147, the fluid chamber 155 is brought into and out of communication with a fluid chamber 159 communicated with the accumulator 5 through a flow passage 157. The spool 143 is normally urged to the right by the biasing force of a spring 161 to provide a seal between the fluid chambers 155 and 159 to thereby block an inflow of the fluid under high pressure into the antipumping valve 17. However, as the spool 143 is pulled leftward through the rod 163 as by a solenoid (not shown) upon receipt of a circuit-closing command, the fluid chambers 151 and 155 are sealed from each other, and the fluid chambers 155 and 159 are brought into communication with each other, to thereby allow the fluid under high pressure to flow into the antipumping valve 17.

The antipumping valve 17 comprises a valve body 165 and a spool 167 including a first land 169, a second land 171 and a flange 173. Depending on the position of the first land 169, a fluid chamber 177 communicated with the low pressure tank 19 through a flow passage 175 is brought into and out of communication with a fluid chamber 179 communicated with the pilot-operated check valve 11 through the flow passage 135. Depending on the position of the second land 171, the fluid chamber 179 is brought into and out of communication with a fluid chamber 181 communicated with the circuit-closing pilot valve 15. A fluid chamber 183 disposed leftward of the flange 173 communicates with the fluid chamber 155 of the circuit-closing valve 15 through a flow passage 187 provided therein with a throttle 185, and a fluid chamber 189 disposed rightward of the flange 173 communicates with the fluid chamber 181 through a small gap between the valve body 165 and second land 171. The spool 167 is normally urged toward the left by a spring 191 to communicate the fluid chambers 179 and 181 with each other. Thus as the circuit-closing pilot valve 15 is actuated upon receipt of a circuit-closing command to cause the fluid under high pressure to be introduced into the fluid chamber 155 from the accumulator 5, the fluid under high pressure is initially introduced into the pilot-operated check valve 11 through the fluid chambers 181 and 179 of the antipumping valve 17 and is also introduced gradually into the fluid chamber 183 leftward of the flange 173 of the antipumping valve 17 through the throttle 185 in the flow passage 153. The flange 173 is formed such that its left-side surface has an effective pressure receiving area greater than that of its right-side surface, and the biasing force of the spring 191 is set at a level such that when the same pressure is applied on the opposite surfaces of the flange 173, the flange 173 is biased rightward. Thus the spool 167 is gradually biased rightward until the land 171 blocks communication between the fluid chambers 181 and 179, and the fluid chambers 179 and 177 are communicated with each other after a predetermined period of time. As a result, the fluid under high pressure in the fluid chamber 133 of the pilot-operated check valve 11 is discharged through the flow passage 135, fluid chambers 179 and 177 and flow passage 175 to the low pressure tank 19.

In operation, the hydraulic operating apparatus is shown as being in a circuit-breaking position in FIG. 1 in which the contact 1 is opened. The upper fluid chamber 31*a* of the actuating cylinder 3 receives the fluid under high pressure from the accumulator 5; the lower fluid chamber 33*b* receives the fluid under high pressure from the accumulator 5 through the control valve 7; and the lower fluid chamber 31*b* surrounding the cushion projection 27*b* communicates with the low pressure tank 19 through the second check valve 47.

Upon receipt of a circuit-closing command, the rod 163 of the circuit-closing pilot valve 15 is pulled leftward as by a solenoid (not shown) and spool 143 is moved leftward. This allows the fluid under high pressure in the accumulator 5 to be fed to the fluid chamber 133 of the pilot-operated check valve 11 through the flow passage 157, the fluid chambers 159 and 155 of the circuit-closing pilot valve 15, flow passage 153, the fluid chambers 181 and 179 of the antipumping valve 17 and flow passage 135 to thereby press the piston 127 downward. This moves the poppet 109 downward, so that the fluid under high pressure is fed from the control valve 7 to the lower fluid chamber 31*b* of the actuating cylinder 3 through the flow passages 41 and 123, the fluid chamber 121 of the pilot-operated check valve 11, the port 119 in the poppet 109, fluid chambers 115 and 117, and flow passage 43 provided therein with the restriction 125. Thus the piston 23 of the actuating cylinder 3 is moved upward by a force commensurate with the difference in effective pressure receiving area between the surfaces of the opposite sides of the piston 23, thereby initiating the closing of the contact 1. As the piston 23 moves upward, the packing 35 is moved away from the projection 37 to provide a clearance between the lower cushion projection 27*b* and the cylinder body 21, so that the fluid under high pressure is directly fed from the lower shock-absorbing fluid chamber 33*b* into the lower fluid chamber 31*b* of the cylinder 3, thereby lifting the piston 23 upward at an increased speed. Once the fluid chambers 33*b* and 31*b* are in communication with each other, the piston 23 continues its upward movement even if the poppet 109 of the pilot-operated check valve 11 is returned to its original position by the action of the anti pumping valve 17 to break communication between the fluid chambers 115 and 117. When the piston 23 comes close to its terminal end position at the side of the piston rod 25, the upper cushion projection 27*a* enters the upper shock-absorbing fluid chamber 33*a* to increase the fluid resistance against the movement of the piston 23 of the fluid from the fluid chamber 31*a* to the fluid chamber 33*b* so that the piston 23 is decelerated. The piston 23 reaches its terminal position at the side of the piston rod 25, thereby completing the operation of closing the circuit. Such circuit-closing condition can be positively maintained over a long period of time since the poppet 67 of the control valve 7 is seated on the valve seat 83 to enable the provision of a positive seal between the fluid chambers 73 and 77.

Upon receipt of a circuit-opening command, the rod 105 of the circuit-breaking pilot valve 9 is pulled leftward as by a force motor (not shown) to move the spool 87 in the same direction. This allows the fluid under high pressure in the fluid chamber 81 of the control valve 7 to be discharged through the flow passage 95, the fluid chambers 97 and 101 of the circuit breaking pilot valve 9, and flow passage 99 to the low pressure tank 19, so that the spool 63 of the control valve 7 is moved leftward by the pressure of the fluid applied on the right side surface 65*a* of the land 65. This blocks communication between the fluid chambers 71 and 73 of the control valve 7, and the fluid chambers 73 and 77 are communicated with each other, so that the fluid under high pressure in the lower shock-absorbing fluid chamber 33*b* and the lower fluid chamber 31*b* of the actuating cylinder 3 is discharged to the low pressure tank 19 through the flow passage 41, the fluid chambers 73 and 77 of the control valve 7 and flow passage 75. Meanwhile the upper shock-absorbing fluid chamber 33*a* receives a supply of fluid under high pressure directly from the accumulator 5 and the upper fluid chamber 31*a* of the cylinder 3 is supplied with fluid under high pressure through the check valve 45 from the accumulator 5, so that the piston 23 of the actuating cylinder 3 is quickly moved downward. As the piston 23 comes close to its lower terminal position and the lower cushion projection 27*b* enters the lower shock-absorbing chamber 33*b*, the fluid flowing from the fluid chamber 31*b* into the fluid chamber 33*b* is subjected to restriction to be increased in fluid resistance, so that the internal pressure of the lower fluid chamber 31*b* of the cylinder 3 is increased and the piston 23 is decelerated. When the piston 23 is further moved close to its lower terminal position, the poppet 49 of the second check valve 47 is pushed downward by the piston 23 to enable the fluid under high pressure in the lower fluid chamber 31*b* of the cylinder 3 to be discharged to the low pressure tank 19 through the port 53, fluid chamber 55 and flow passage 57 having therein the restriction 59. When the piston 23 eventually reaches its lower terminal position, the packing 35 is seated on the projection 37 to completely block communication between the lower fluid chamber 31*b* and the lower shock-absorbing fluid chamber 33*b*. Thereafter, when the circuit-opening command is cancelled, the spool 87 of the circuit-opening pilot valve 9 is returned to its original right position by the biasing force of the spring 103 to introduce the fluid under pressure into the fluid chamber 81 of the control valve 7. Accordingly, the spool 63 of the control valve 7 is moved rightward into the position shown in FIG. 1. Thus the lower shock-absorbing fluid chamber 33*b* of the cylinder 3 is again supplied with fluid under high pressure from the accumulator 5 through the control valve 7, and the piston 23 is held in its lower position by virtue of the sealing action of the packing 35. The operation of opening the circuit is now completed. The circuit can be positively kept in the open position over a long period of time since the packing 35 is tightly forced against the projection 37 by the piston 23 and the poppet 67 of the control valve 7 is seated on the valve seat 83 to enable positively blocking communication between the fluid chambers 73 and 71 in the same manner as in the circuit-closing condition.

The first embodiment provide the following advantages:

(1) The packing 35 provides a positive sealing characteristics in the opened condition of the circuit. In the control valve 7, a seal is provided only between the poppet 67 and the valve seat 83 during both circuit-closing and circuit-opening conditions, which can make the construction of the control valve simple. In the pilot-operated check valve 11, sealing is effected only between the poppet 109 and the valve seat 113, which facilitates fabrication of the parts of the apparatus.

(2) The hydraulic operating apparatus has a high reliability in performance. For example, even if the packing 35 were damaged to cause leakage of the fluid under high pressure from the fluid chamber 33*b* to the fluid chamber 31*b* in the opened condition of the contact, any inadvertent circuit-closing operating by the piston 23 could be avoided because the fluid in the fluid chamber 31*b* is discharged through the second check valve 47*b*.

(3) The pilot-operated check valve 11 is capable of operating positively in response to a circuit-closing command because the valve 11 has only to behave as a trigger for the circuit-closing operation.

The first embodiment has been described as being incorporated in an emergency circuit breaker for an electric power system. However, the apparatus can be applied to an emergency relief valve suitable for use in turbine plants using high temperature gases or steam.

Figure 2:
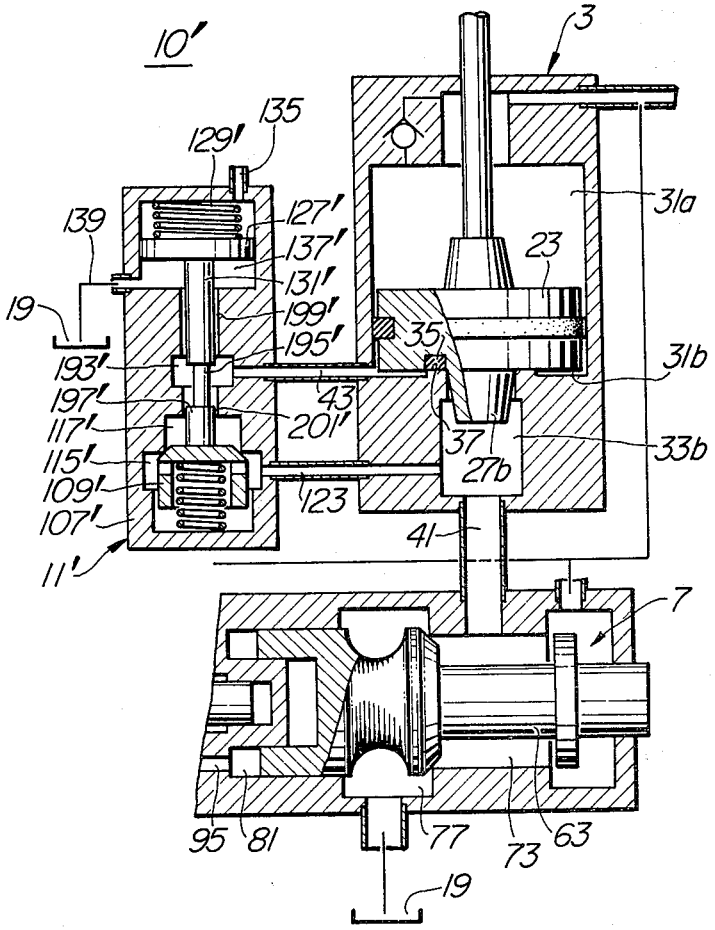
FIG. 2 is a fragmentary sectional view of a hydraulic driving apparatus according to a second embodiment of the invention.

FIG. 2 shows a hydraulic operating apparatus (10') according to a second embodiment of the invention, In FIG. 2, like reference numerals designate parts similar or equivalent to those shown in FIG. 1. In FIG. 2, the circuit-breaking pilot valve 9 and pilot section 13 shown in FIG. 1 are omitted for the purpose of clarity.

The second embodiment shown in FIG. 2 is different from the first embodiment of FIG. 1 in the course along which the fluid in the lower fluid chamber 31*b* of the actuating cylinder 3 is discharged to the low pressure tank 19. More specifically, in the second embodiment, the second check valve 47 shown in FIG. 1 is dispensed with and the pilot-actuated check valve 11' serves as a second check valve and is adapted to discharge the fluid in the lower fluid chamber **31*b* to the low pressure tank 19**.

The pilot-operated check valve 11' has another fluid chamber 193' between the fluid chambers 117' and 137' in the valve body 107', said fluid chamber 193' being communicated with the lower fluid chamber **31*b* of the cylinder 3 through the flow passage 43. The piston rod 131' disposed in the pilot-operated check valve 11' is formed at its end with a small diameter portion 195' extended through the fluid chamber 193', and a land 197' of the same diameter as the piston rod 131' is connected to the forward end of the small diameter portion 195'. The land 197' is biased by a spring 129' against the poppet 109' at its forward end at all times. Defined between the piston rod 131' and the valve body 107' is a narrow gap 199' having a throttling action, and a similar narrow gap 201' is defined between the land 197' and the valve body 107'**. The second embodiment is similar in other parts of the construction to the first embodiment and their description will be omitted.

In operation, the hydraulic operating apparatus 10' shown in FIG. 2 is in a position in which a circuit-breaking operation has been performed in response to a first command or circuit-opening command. In this position, the upper fluid chamber **31*a* of the actuating cylinder 3 receives a supply of fluid under high pressure from the accumulator 5 and the lower shock-absorbing fluid chamber 33*b* receives a supply of fluid under high pressure through the control valve 7. However, a low pressure prevails in the lower fluid chamber 31*b* of the cylinder 3 which then is maintained in direct communication with the low pressure tank 19 through the fluid chamber 193', gap 199' and fluid chamber 137' of the pilot-operated check valve 11'**.

Upon receipt of a second command or circuit-closing command, a pilot fluid pressure from the circuit-opening pilot section 13 (See FIG. 1) enters the pilot-operated check valve 11 through the flow passage 135 to push the piston 127' downward and then to move the poppet 109 downward, so that the fluid chambers 115', 117' and 193' are brought into communication with one another to permit the fluid under high pressure in the lower shock-absorbing chamber **33*b* to be fed into the lower fluid chamber 31*b* of the cylinder 3 through a flow passage 123, thereby moving the piston 23 upwardly. Thereafter, the piston 23 moves upward until it reaches its upper terminal position in the same manner as described with respect to the first embodiment shown in FIG. 1**.

Assume that a first command is given when the piston 23 is in its upper terminal position. The spool 87 of the pilot valve 9 is pulled leftward, and the fluid under high pressure in the fluid chamber 81 of the control valve 7 is discharged therefrom through the flow passage 95 in the same manner as described with respect to the first embodiment shown in FIG. 1. Accordingly, the spool 63 of the control valve 7 is moved leftward, so that the fluid under high pressure in the lower fluid chamber **31*b* and the lower shock-absorbing fluid chamber 33*b* of the cylinder 3 is discharged to the low pressure tank 19 through the flow passage 41 and the fluid chambers 73 and 77 of the control valve 7, thereby forcing the piston 23 downward. As the piston 23 comes close to its lower terminal position with the lower cushion projection 27*b* entering the lower shock-absorbing fluid chamber 33*b*, flow of fluid from the fluid chamber 31*b* to the fluid chamber 33*b* is subjected to restriction between the cushion projection 27*b* and the projection 37, to thereby build up a high fluid pressure in the lower fluid chamber 31*b* for deceleration of the piston 23**.

At this time, the fluid under high pressure in the lower fluid chamber **31*b* of the cylinder 3 flows into the fluid chamber 193' of the pilot-operated check valve 11' through the flow passage 43. Since the piston rod 131' and land 197' are of the same diameter, the fluid pressure is balanced tending not to move the piston 127'. Of the fluid flowing into the fluid chamber 193', excess fluid escapes through the gaps 199' and 201' to the fluid chambers 137' and 117' respectively. Upon the piston 23 reaching its lower terminal position, the packing 35 is seated on the projection 37 to thereby completely block communication between the fluid chambers 31*b* and 33*b*. Since the lower fluid chamber 31*b* of the cylinder 3 communicates with the low pressure tank 19 through the flow passage 43, the fluid chamber 193', gap 199' and fluid chamber 137' of the pilot-operated check valve 11 and flow passage 139, the internal pressure in the lower fluid chamber 31*b* is reduced. Thereafter, the control valve 7 operates in the same manner as described with respect to the first embodiment shown in FIG. 1, and the description thereof will be omitted. The control valve 7 is capable of holding the piston 23 in its lower terminal position in the same manner as the piston 23** is held in its upper terminal position.

Figure 3:
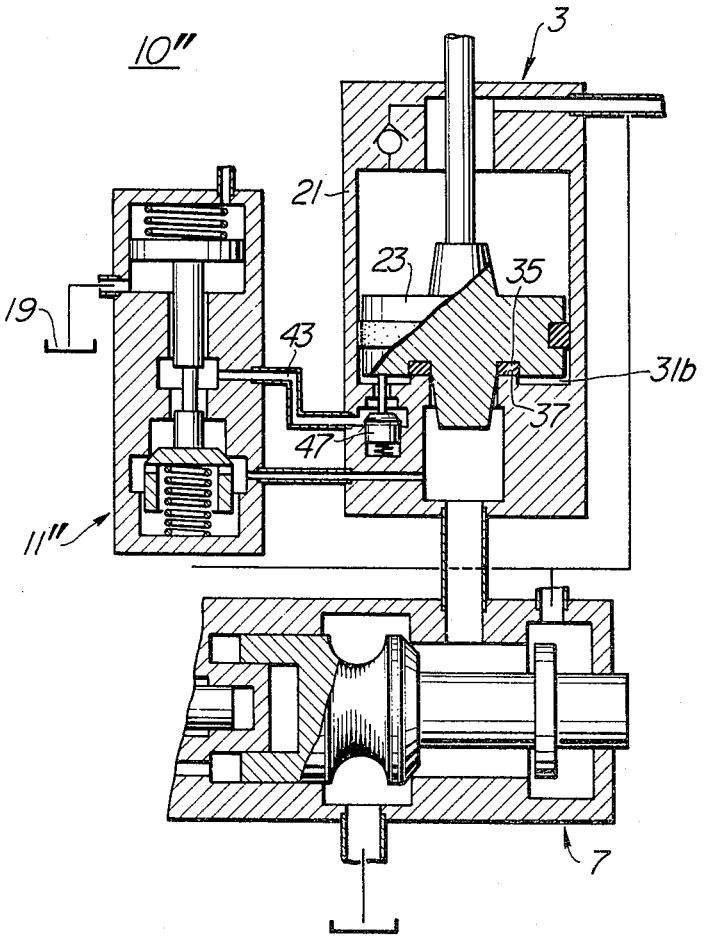
FIG. 3 is a fragmentary sectional view of a hydraulic driving apparatus according to a third embodiment of the invention.

FIG. 3 shows a hydraulic operating apparatus 10'' according to a third embodiment of the invention. In FIG. 3, parts similar or equivalent to those shown in FIGS. 1 and 2 are designated by like reference numerals. In FIG. 3, the circuit-breaking pilot valve 9 and circuit-closing pilot section 13 shown in FIG. 1 are omitted for the purpose of clarity.

The third embodiment shown in FIG. 3 is different from the embodiments shown in FIGS. 1 and 2 in the course along which fluid in the lower fluid chamber **31*b* of the actuating cylinder is discharged to the low pressure tank 19. More specifically, in the third embodiment shown in FIG. 3, the fluid in the lower fluid chamber 31*b* is discharged through the second check valve 47 in the cylinder 3, flow passage 43 and pilot-operated check valve 11'' to the low pressure tank 19. The second check valve 47 is of the same construction as that shown in FIG. 1, and the pilot-operated check valve 11'' is of the same construction as that shown in FIG. 2. It will be seen that the third embodiment is a combination of the first and second embodiments and the construction and operation of various parts thereof are the same as those shown in FIGS. 1 and 2**. Therefore, detailed description will be omitted.

In each of the embodiments described hereinabove, the packing 35 which divides the lower pressure receiving surface at the underside of the piston 23 of the actuating cylinder 3 into two pressure receiving surface sections when the piston 23 is disposed in its lower terminal position is described as being mounted on the piston 23. However, the packing 35 may be mounted in the position where the projection 37 is provided on the cylinder body 21.

From the foregoing description, it will be appreciated that the control valve 7 is simple in construction and sealing performance has a high reliability, because the control valve 7 has only one sealing portion when the piston 23 of the actuating cylinder 3 is disposed in either one of its lower and upper terminal positions. The sealing means (packing 35, for example) for dividing the pressure receiving surface of the piston on the opposite side of the piston rod 25 into two pressure receiving surface sections when the piston 23 of the actuating cylinder 3 is situated at its lower terminal position is very simple in construction, so that fabrication is facilitated and yet a seal can be positively provided.

What is claimed is:

1. A hydraulic operating apparatus comprising:

an actuating cylinder;

a piston movable in said actuating cylinder and provided on one side with a piston rod; and a control valve for applying a fluid under high pressure to a pressure receiving surface of said piston on the side of said piston opposite to the side provided with said piston rod to move said poston in a direction in which the piston rod extends from the piston and for discharging the fluid existent on the side of the piston opposite said piston rod to move said piston in a direction opposite the direction in which the piston rod extends from the piston;

wherein the improvement comprises:

sealing means for dividing the pressure receiving surface of the piston on the opposite side of said piston rod into a first pressure receiving surface section and a second pressure receiving surface section when the piston is disposed at its terminal position on the side of said piston opposite said piston rod, said first pressure receiving surface section having an effective pressure receiving area smaller than that of a pressure receiving surface of the piston on the side of said piston rod, whereby the fluid under high pressure is only applied to said first pressure receiving surface section when said piston is held at its terminal position at the side of the piston opposite the piston rod, and the fluid under pressure is applied to said first and second pressure receiving surface sections when said piston is moved away from its terminal position opposite the piston rod; and a pilot-operated check valve provided in a fluid passage communicating a first fluid chamber with a second fluid chamber when said piston is disposed in its terminal position opposite the piston rod, said first fluid chamber facing said first pressure receiving surface section and said second fluid chamber facing said second pressure receiving surface section, said pilot-operated check valve being oriented for executing an opening movement in a direction opposite to a direction of flow of the fluid under high pressure from said first fluid chamber to said second fluid chamber and being adapted to be forcedly opened temporarily by the action of a pilot fluid pressure for moving the piston away from its terminal position opposite the piston rod to thereby cause the fluid under high pressure acting on said first pressure receiving surface section to act also on said second pressure receiving surface section.

2. An apparatus as set forth in claim 1 further comprising a check valve adapted to be opened by said piston when the latter is disposed near or at its terminal position opposite the piston rod, and to allow said second fluid chamber to communicate with a low pressure tank.

3. An apparatus as set forth in claim 2, wherein said pilot-operated check valve comprises a cylinder for forcedly and temporarily opening the pilot-operated check valve, and a piston rod arranged in said cylinder and defining a gap therewith, said second fluid chamber being allowed to communicate with a low pressure tank through said gap when said piston is disposed at its terminal position opposite the piston rod.

4. An apparatus as set forth in claim 1 wherein said pilot-operated check valve comprises a cylinder for forcedly and temporarily opening the pilot-operated check valve, and a piston rod arranged in said cylinder and defining a gap therewith, said second fluid chamber being allowed to communicate with a low pressure tank through said gap when said piston is disposed at its terminal position opposite the piston rod.

5. An apparatus as set forth in claim 1, wherein said piston includes a cushion projection for deceleration of said piston when the latter comes close to its terminal position on its side opposite the piston rod, said cushion projection cooperating with said sealing means to divide the pressure receiving surface of the piston on its side opposite the piston rod into said first and second pressure receiving surface sections when said piston is disposed at its terminal position opposite the piston rod.

6. An apparatus as set forth in claim 5 wherein sealing is performed only at one place in said control valve whether said piston is disposed at its terminal position opposite the piston rod or at its terminal position on the side of the piston rod.

7. An apparatus as set forth in claim 1 further comprising a circuit-closing section including an antipumping valve operative to forcedly open said pilot-operated check valve for a predetermined time to perform an anti-pumping operation.

8. An apparatus as set forth in claim 1, wherein said sealing means is a disengageable sealing means that is constructed to disengage when said piston is positioned away from its terminal position at the side of the piston opposite the piston rod.

9. An apparatus as set forth in claim 8, wherein said disengageable sealing means comprises sealing surfaces on said piston and actuating cylinder that are mutually engaged when the piston is disposed in said terminal position at the side of the piston opposite the piston rod, whereby said first and second fluid chambers are formed upon engagement of said sealing surfaces, and said first and second fluid chambers are united upon disengagement of said sealing surfaces.

* * * * *